US012402773B2

(12) United States Patent
Durham et al.

(10) Patent No.: US 12,402,773 B2
(45) Date of Patent: Sep. 2, 2025

(54) MULTICHANNEL DISPENSER ASSEMBLY

(71) Applicant: Haier US Appliance Solutions, Inc., Wilmington, DE (US)

(72) Inventors: Kyle Edward Durham, Louisville, KY (US); Ryan Joseph Shaffer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 126 days.

(21) Appl. No.: 18/457,695

(22) Filed: Aug. 29, 2023

(65) Prior Publication Data

US 2025/0072710 A1 Mar. 6, 2025

(51) Int. Cl.
*A47L 15/44* (2006.01)

(52) U.S. Cl.
CPC ..... *A47L 15/4463* (2013.01); *A47L 15/4418* (2013.01); *A47L 15/449* (2013.01)

(58) Field of Classification Search
None
See application file for complete search history.

(56) References Cited

U.S. PATENT DOCUMENTS

| | | | |
|---|---|---|---|
| 7,054,719 | B2 | 5/2006 | Pham et al. |
| 9,109,710 | B2 | 8/2015 | Hasse et al. |
| 9,307,886 | B2 | 4/2016 | Durham et al. |
| 10,780,470 | B2 | 9/2020 | Saier et al. |
| 11,389,843 | B2 | 7/2022 | Saier et al. |
| 2014/0263085 | A1 | 9/2014 | Mitchell et al. |

FOREIGN PATENT DOCUMENTS

| | | | |
|---|---|---|---|
| CA | 3032660 | C | 11/2020 |
| EP | 1789708 | B1 | 10/2011 |
| JP | 6442514 | B2 | 12/2018 |
| WO | WO2017218113 | A1 | 12/2017 |
| WO | WO2022074442 | A1 | 4/2022 |

OTHER PUBLICATIONS

Rold, "Rold MD Series Multidosing Pump", Rold Connected to Innovation, Retrieved from internet: https://www.rold.com/wp-content/uploads/2022/05/MD_MULTIDOSING-Pump.pdf.

*Primary Examiner* — Levon J Shahinian
(74) *Attorney, Agent, or Firm* — Dority & Manning, P.A.

(57) ABSTRACT

A dispenser assembly includes a housing including a plurality of inlets and an outlet. The housing defines a first portion of a flow path. A rotatable disk is positioned within the housing, and the rotatable disk includes a groove in a top side of the rotatable disk. The groove defines a second portion of the flow path. A positioning wheel is coupled to the rotatable disk. A motor is mechanically coupled to the positioning wheel for driving rotation of the rotatable disk about an axis to align the groove of the rotatable disk with one of the plurality of inlets. When the groove of the rotatable disk engages with one of the plurality of inlets, the first portion of the flow path and the second portion of the flow path mesh to provide the flow path between one of the plurality of inlets and the outlet.

20 Claims, 7 Drawing Sheets

MULTICHANNEL DISPENSER ASSEMBLY

FIELD OF THE INVENTION

The present invention relates generally to washing appliances, such as dishwashing appliances, and more specifically to a multichannel dispenser assembly for such appliances.

BACKGROUND OF THE INVENTION

Domestic appliances may include dishwashers, washing machines, dryers, and other appliances. Certain domestic appliances, hereinafter collectively referred to as "washing appliances," are configured for washing items such as dishes or clothing articles. Washing appliances, such as washing machine appliances and dishwasher appliances generally include a tub that defines a wash chamber and a pump for directing fluids from a fluid reservoir into the wash chamber during washing operations.

For example, washing appliances generally include a dispenser for dispensing one or more additives, such as dish detergent, laundry detergent, or other treatment chemicals such as rinse aid, fabric softener, etc., into the wash chamber. Traditionally, such dispensers either mix the fluids or maintain distinct channels. Mixing the fluids may be undesirable in some cases, such as a washing cycle, e.g., a dishwasher cycle, where specific liquids are desired to be dispensed at specific times. Further, maintaining distinct channels may be undesirable because separate control devices may be required for all channels, thereby adding complexity.

Accordingly, a dispenser assembly for selectively dispensing separate wash fluids without separate control devices to maintain distinct channels would be advantageous.

BRIEF DESCRIPTION OF THE INVENTION

Aspects and advantages of the invention will be set forth in part in the following description, or may be obvious from the description, or may be learned through practice of the invention.

In one example embodiment, a washing appliance includes a wash chamber for receipt of articles for washing, a door for selectively opening and closing the wash chamber, and a dispenser assembly. The dispenser assembly includes a housing including a plurality of inlets and an outlet. The housing defines a first portion of a flow path. A rotatable disk is positioned within the housing, and the rotatable disk includes a groove in a top side of the rotatable disk. The groove is configured to selectively align with one of the plurality of inlets. The groove defines a second portion of the flow path. A positioning wheel is coupled to the rotatable disk. The positioning wheel is configured to provide positional feedback of the rotatable disk. A motor is mechanically coupled to the positioning wheel for driving rotation of the rotatable disk about an axis to align the groove of the rotatable disk with one of the plurality of inlets. When the groove of the rotatable disk engages with one of the plurality of inlets, the first portion of the flow path and the second portion of the flow path mesh to provide the flow path between one of the plurality of inlets and the outlet.

In another example embodiment, a dispenser assembly includes a housing including a plurality of inlets and an outlet. The housing defines a first portion of a flow path. A rotatable disk is positioned within the housing, and the rotatable disk includes a groove in a top side of the rotatable disk. The groove is configured to selectively align with one of the plurality of inlets. The groove defines a second portion of the flow path. A positioning wheel is coupled to the rotatable disk. The positioning wheel is configured to provide positional feedback of the rotatable disk. A motor is mechanically coupled to the positioning wheel for driving rotation of the rotatable disk about an axis to align the groove of the rotatable disk with one of the plurality of inlets. When the groove of the rotatable disk engages with one of the plurality of inlets, the first portion of the flow path and the second portion of the flow path mesh to provide the flow path between one of the plurality of inlets and the outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
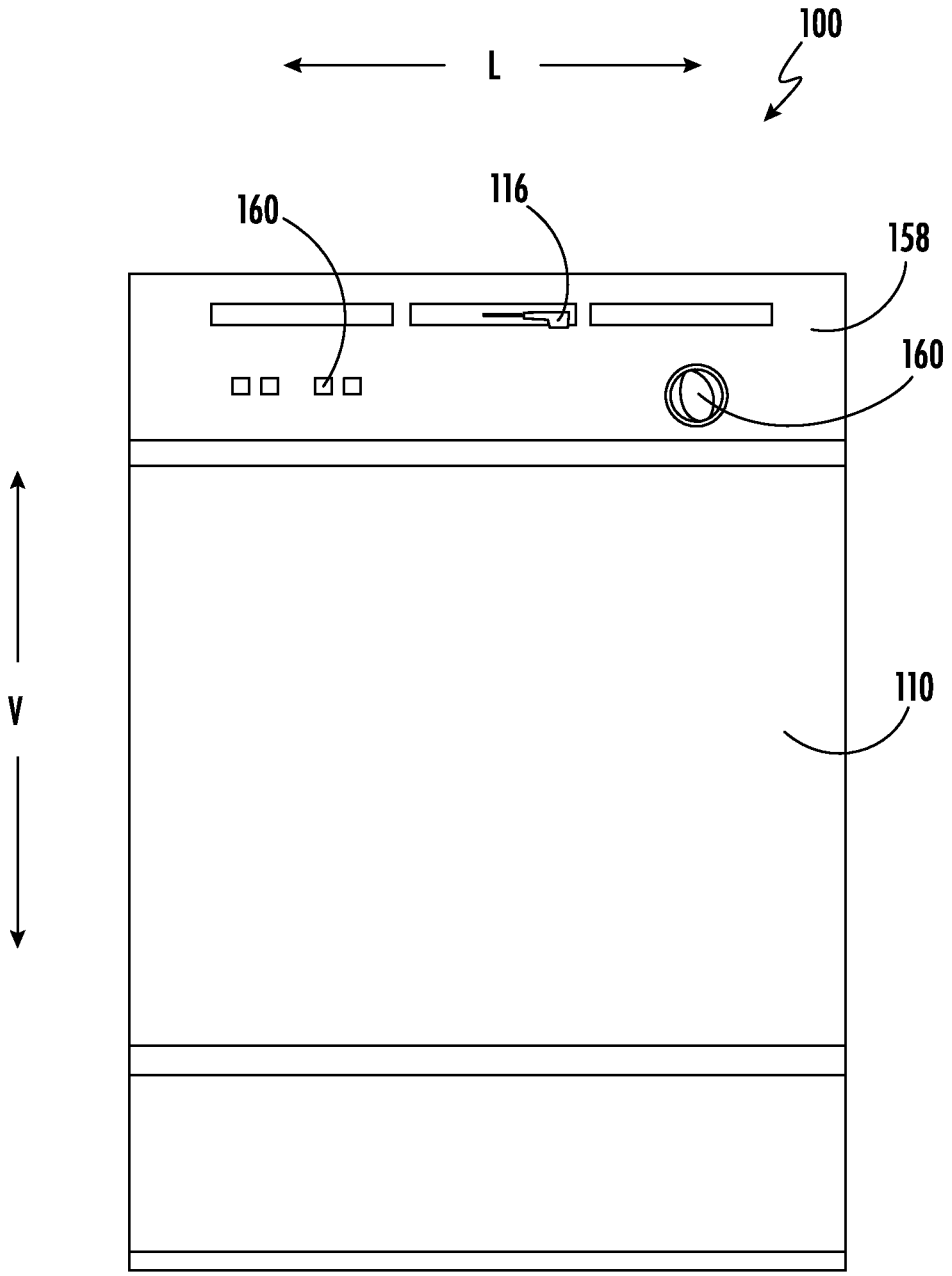
FIG. 1 provides a front view of a dishwashing appliance in accordance with an embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The term "article" may refer to, but need not be limited to, dishes, pots, pans, silverware, and other cooking utensils and items that can be cleaned in a dishwashing appliance; garments, fabrics, textiles, linens, clothing and other clothing articles and items that can be cleaned in a laundry appliance. In The term "fluid" refers to a liquid used for washing and/or rinsing the articles and is typically made up of water that may include additives such as detergent or other treatments, such as liquid detergent, powder detergent, bleach, and softener. The terms "first" and "second" may be used interchangeably to distinguish one component from another and are not intended to signify the location or importance of the individual components.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

While described in the context of a dishwashing appliance as an example of a washing appliance, the present disclosure may be used in any suitable washing appliance. For example, aspects of the present disclosure may include different embodiments of a washing appliance including a tub, a wash chamber, and fluids flowing into the wash chamber. Washing appliances may generally include dishwashers, washing machines, and other appliance, e.g., washing machines and dishwashers generally include a tub that defines a wash chamber and a pump for directing fluids from a fluid reservoir into the wash chamber during washing operations.

Figure 2:
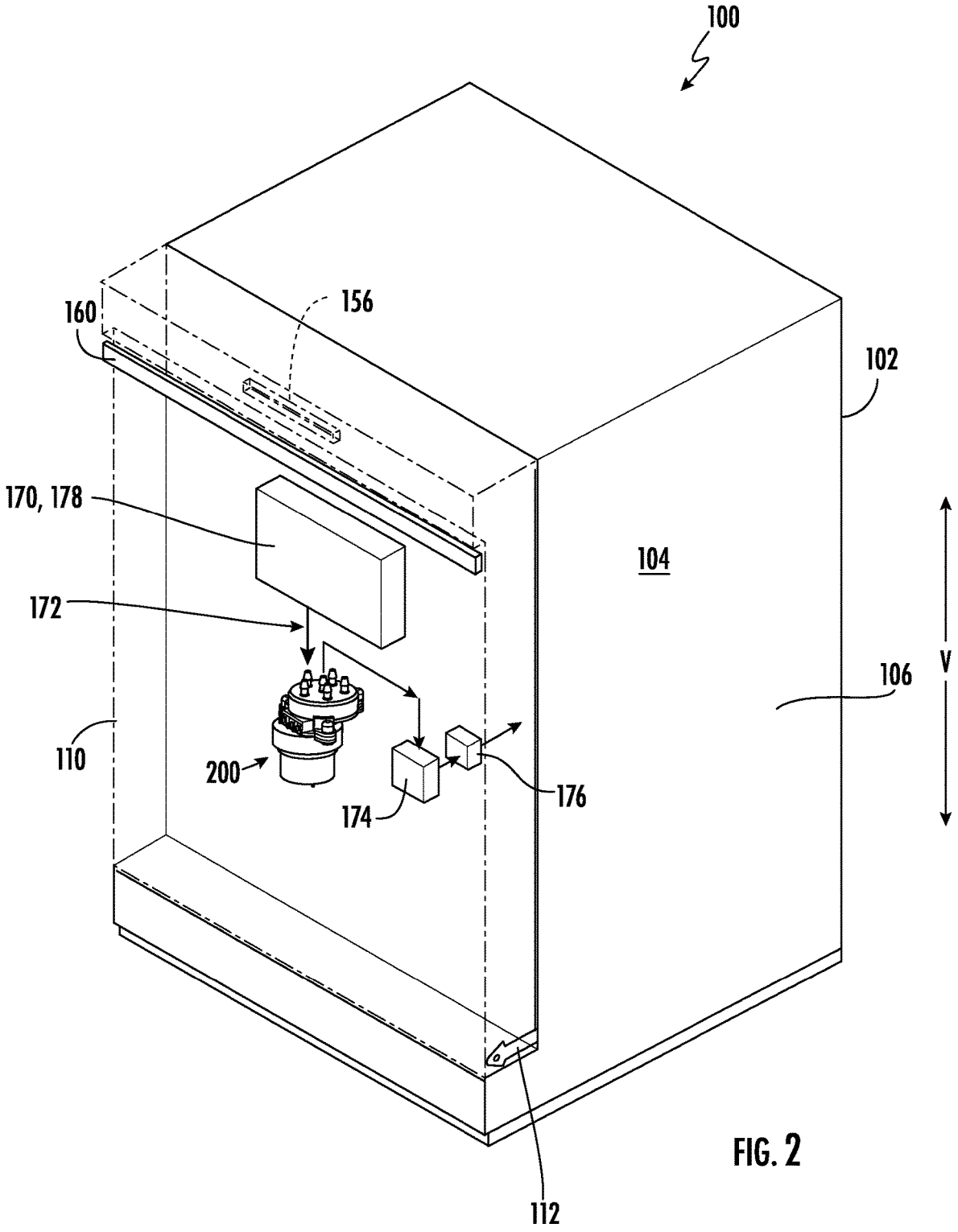
FIG. 2 provides a perspective view of the dishwashing appliance of FIG. 1 with a door of the dishwashing appliance hidden to expose other components in accordance with aspects of the present disclosure.

Referring now to the drawings, FIGS. 1 and 2 illustrate a front view of a washing appliance that may be configured in accordance with aspects of the present disclosure. For the particular example embodiment of FIGS. 1 and 2, the washing appliance is a dishwashing appliance 100. As stated above, dishwashing appliance 100 is provided for example purposes only and the present subject matter may be used in any suitable washing appliances, such as washing machines and dishwashers. As shown particularly in FIG. 2, dishwashing appliance 100 includes a cabinet 102 having a tub 104 therein that defines a wash chamber 106 for the receipt of articles for washing. Tub 104 may include a front opening (not shown) and a door 110 for selectively opening and closing the wash chamber 106. As shown, door 110 may be hinged to wash chamber 106 for movement between a closed position (shown in FIGS. 1 and 2) and an open position for loading and unloading articles into and from the dishwasher appliance 100. In addition, as shown, a latch 116 may be used to lock and unlock the door 110 for access to the wash chamber 106.

As shown in FIG. 2, the dishwashing appliance 100 may be further equipped with a controller 156 to regulate operation of the dishwashing appliance 100. Controller 156 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In an embodiment, the processor executes programming instructions stored in the memory. The memory may be a separate component from the processor or may be included onboard within the processor. Further, controller 156 may be positioned in a variety of locations throughout dishwashing appliance 100. In the illustrated embodiment, for example, controller 156 may be located within a control panel area 158 of door 110 as shown in FIG. 1. Typically, controller 156 includes a user interface panel/control 160 through which a user may select various operational features and modes and monitor progress of the dishwashing appliance 100.

Referring particularly to FIG. 2, the dishwashing appliance 100 may further include a fluid reservoir 170 containing a plurality of fluids 178 for washing and/or rinsing the articles within the wash chamber 106. Furthermore, as shown, dishwashing appliance 100 may also include a pump 174 for directing or pumping the plurality of fluids 178 from the fluid reservoir 170 and into the wash chamber 106. Further, and as will be discussed in more detail herein, the dishwashing appliance 100 may include a dispenser assembly 200 for controlling the plurality of fluids 178 flowing from the fluid reservoir 170 and into the wash chamber 106 along a flow path 172.

Thus, as shown in FIG. 2, the dispenser assembly 200 may be in fluid communication with a dispenser 176 in fluid communication with the dispenser assembly 200 for dispensing one of the plurality of different fluids into the wash chamber 106 at a time. As shown in FIG. 2, the fluid reservoir 170, the pump 174, the dispenser 176, and the dispenser assembly 200 may be disposed within door 110. As such, FIG. 2 depicts the fluid reservoir 170, the dispenser assembly 200, the pump 174, and the dispenser 176 as having a particular arrangement along the flow path 172. However, it should be understood that such an arrangement is not limiting, and a variety of arrangements can be implemented in accordance with the present disclosure. For example, the pump 174 and the dispenser 176 can be arranged in a different order along the flow path 172 such that the dispenser 176 is disposed adjacent or connected to the dispenser assembly 200.

Figure 3:
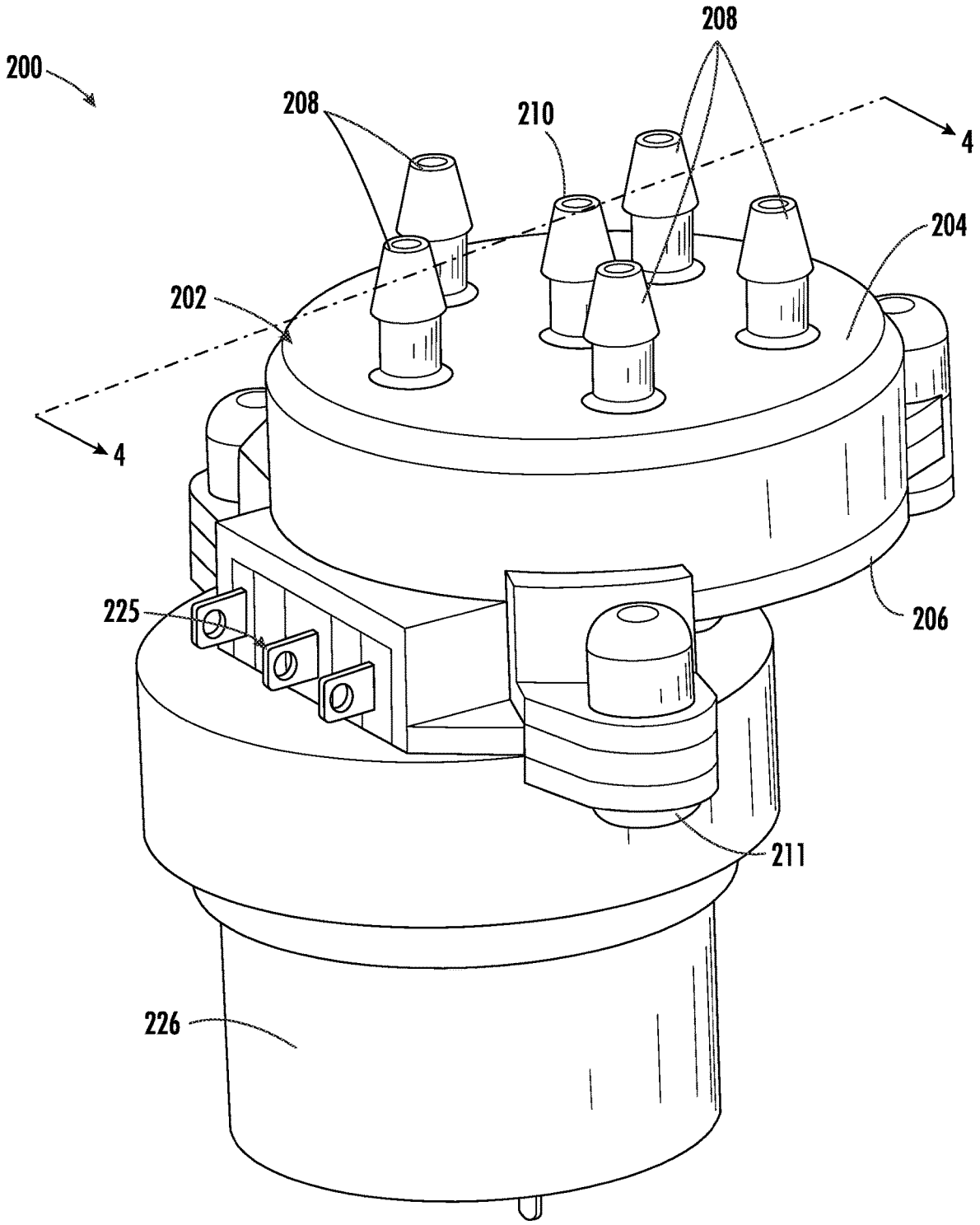
FIG. 3 provides a perspective view of a multichannel dispenser assembly in accordance with an embodiment of the present disclosure.
Figure 4:
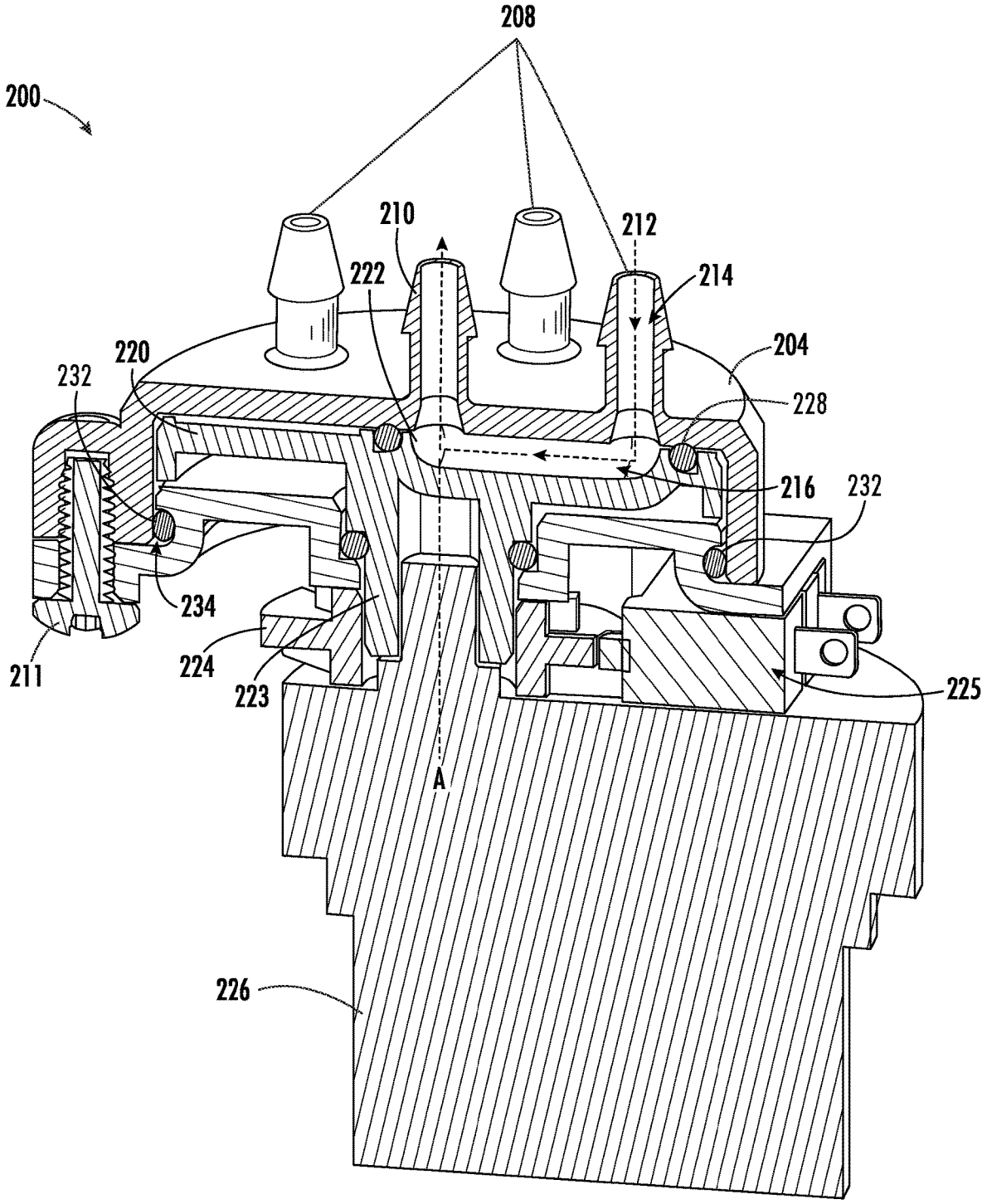
FIG. 4 provides a sectional view of the multichannel dispenser assembly of FIG. 3 along line 4-4.

Referring now to FIG. 3, a perspective view of the dispenser assembly 200 according to an example embodiment of the present disclosure is illustrated. The dispenser assembly 200 can be used with a variety of appliances, e.g., any suitable washing appliance, such as the dishwashing appliance 100 of FIGS. 1 and 2 or another washing appliance. As shown, the dispenser assembly 200 includes a housing 202 which may include a plurality of inlets 208 and an outlet 210. In particular, the plurality of inlets 208 and outlet 210 may extend from housing 202, such that the plurality of inlets 208 and outlet 210 extend in a parallel direction. Further, the plurality of inlets 208 may include any suitable number of inlets, such as five (5) separate inlets as shown. In further embodiments, housing 202 of dispenser assembly 200 may have more or less than five (5) separate inlets. In some embodiments, housing 202 of the dispenser assembly 200 may also have a first housing portion 204 detachably secured to a second housing portion 206. Referring briefly to FIG. 4, dispenser assembly 200 may also include at least one housing seal 232. Generally, housing seal 232 may be arranged between the first housing portion 204 and the second housing portion 206. In particular, housing seal 232 may be positioned within a recess 234 of second housing portion 206. Further, in some embodiments, the first housing portion 204 and the second housing portion 206 may be secured together via one or more fasteners 211. In some embodiments, the fastener(s) 211 can include a variety of different fasteners, such as screws, nuts and bolts, or any other suitable fasteners.

Referring now to FIG. 4, a cross-sectional view of the dispenser assembly 200 of FIG. 3 along line 4-4 is illustrated. As shown, the dispenser assembly 200 includes a rotatable disk 220 positioned within housing 202. The rotatable disk 220 may have a groove 222 on a top side 221 of the rotatable disk 220, and the groove 222 may be configured to selectively align with one of the plurality of inlets 208 of the housing 202 to provide a flow path 212 between one of the plurality of inlets 208 and the outlet 210. For example, each inlet of the plurality of inlets 208 of the housing 202 may define a first portion 214 of flow path 212 and groove 222 of rotatable disk 220 may define a second portion 216 of flow path 212, such that when the groove 222 of the rotatable disk 220 engages with one of the plurality of inlets 208, the first portion 214 of the flow path 212 and the second portion 216 of the flow path 212 mesh to provide the flow path 212 between one of the plurality of inlets 208 and the outlet 210.

Figure 5:
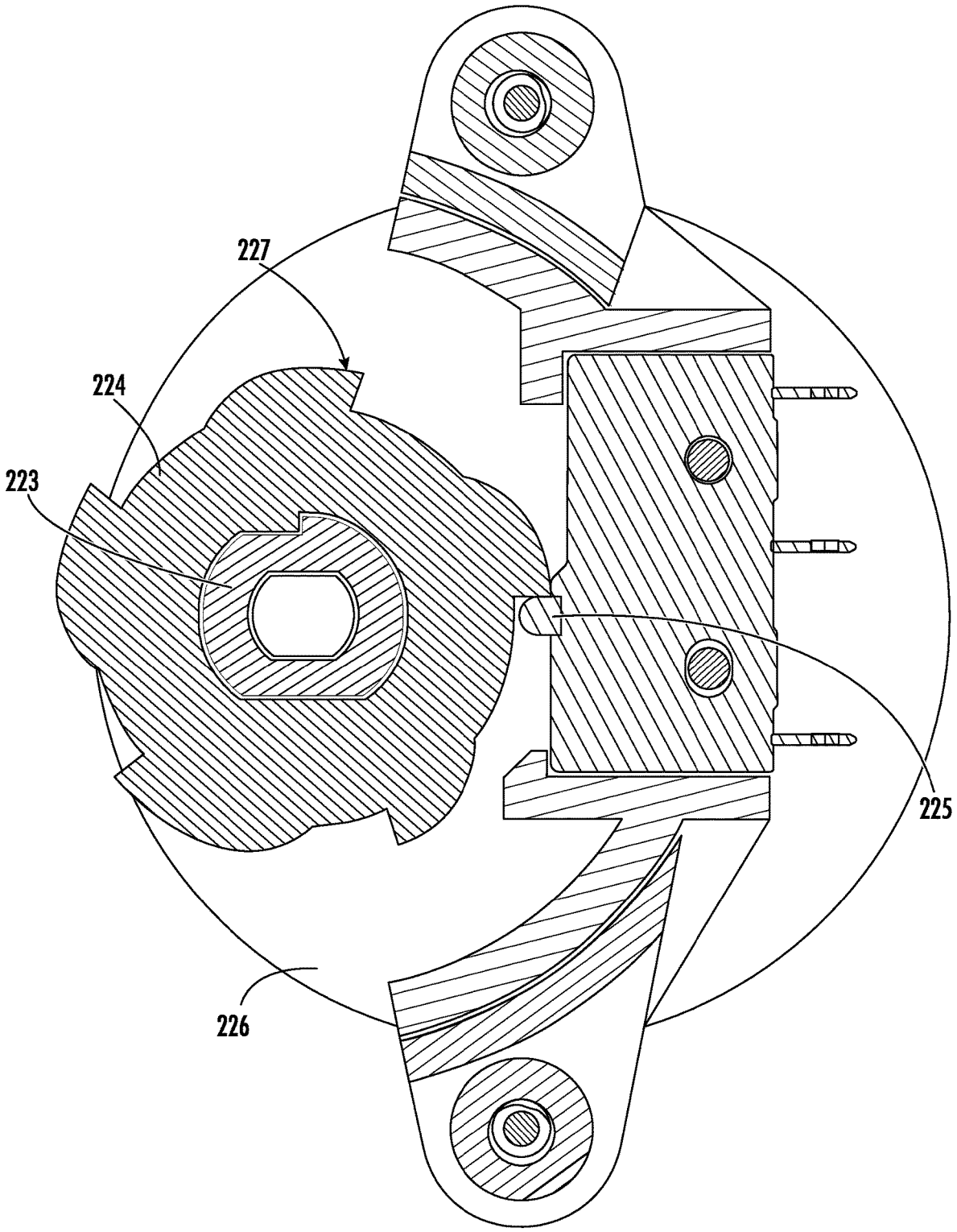
FIG. 5 provides a top, section view of the multichannel dispenser assembly of FIG. 3.

Referring to FIGS. 4 and 5, the rotatable disk 220 may have a protrusion 223 extending through the second housing portion 206 and into a positioning wheel 224. Protrusion 223 may be mechanically coupled to a motor 226, such as a geared motor, for driving rotation of the positioning wheel 224 and rotatable disk 220 about an axis A. As such, the motor 226 shown in FIG. 4 drives the rotatable disk 220 about the axis A to align the groove 222 of the rotatable disk 220 with one of the plurality of inlets 208. In general, positioning wheel 224 may be configured to provide positional feedback of the rotatable disk 220. As shown in FIG. 5, positioning wheel 224 may include a ramp 227, or a plurality of ramps 227 circumferentially spaced around positioning wheel 224. For example, each ramp 227 may be configured to engage with a switch 225, in electrical communication with controller 156, to provide positional feedback of the rotatable disk 220. In particular, each ramp 227 may be circumferentially differing lengths, such as to differentiate positions of positioning wheel 224 and thus rotatable disk 220.

Figure 6:
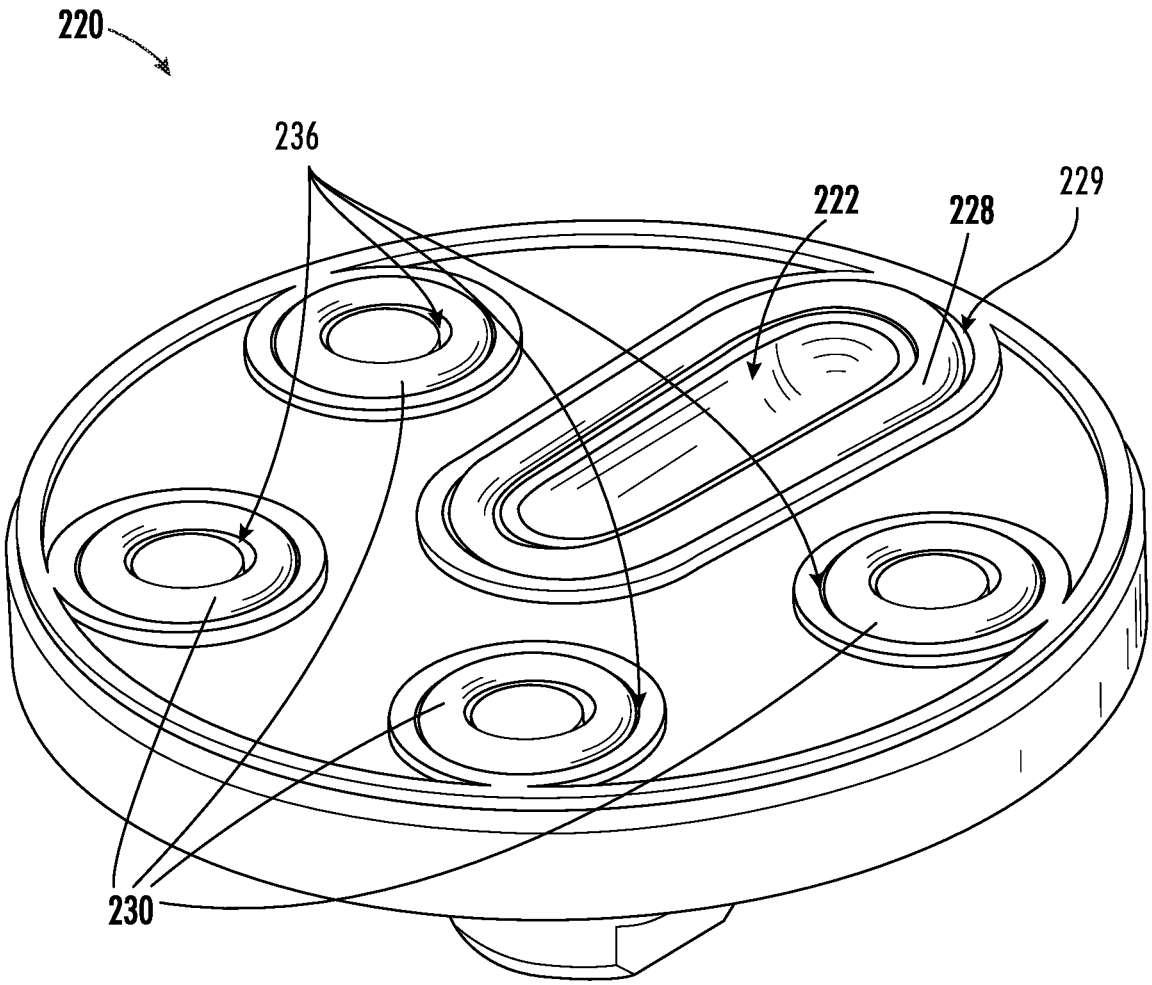
FIG. 6 provides alternative embodiments of a seal for a multichannel dispenser assembly in accordance with an embodiment of the present disclosure.

Referring to FIG. 6, dispenser assembly 200 may also include a groove seal 228 disposed around groove 222. The groove seal 228 may be configured for engaging housing 202, such as first housing portion 204, and fluidly sealing flow path 212, e.g., groove seal 228 may fluidly seal between first housing portion 204 and rotatable disk 220. In particular, groove seal 228 may be positioned in a groove seal recess 229 around groove 222. Furthermore, a plurality of inlet seals 230 may be disposed within rotatable disk 220 for fluidly separating each of the plurality of inlets 208 of first housing portion 204. For example, the plurality of inlet seals 230 may be configured to engage with each of the plurality of inlets 208 when inlets 208 are not engaging with groove 222. In particular, each inlet seal of the plurality of inlet seals 230 may be positioned within a respective recess of a plurality of recesses 236 formed into the rotatable disk 220. The plurality of recesses 236 may be positioned in the rotatable disk 220 relative to the position of the plurality of inlets 208 of the housing 202, when the dispenser assembly 200 is assembled. In certain embodiments, such as shown in FIG. 6, the inlet seal(s) 230 and/or the housing seal 232 may be O-rings or any other suitable flexible seal.

Figure 7:
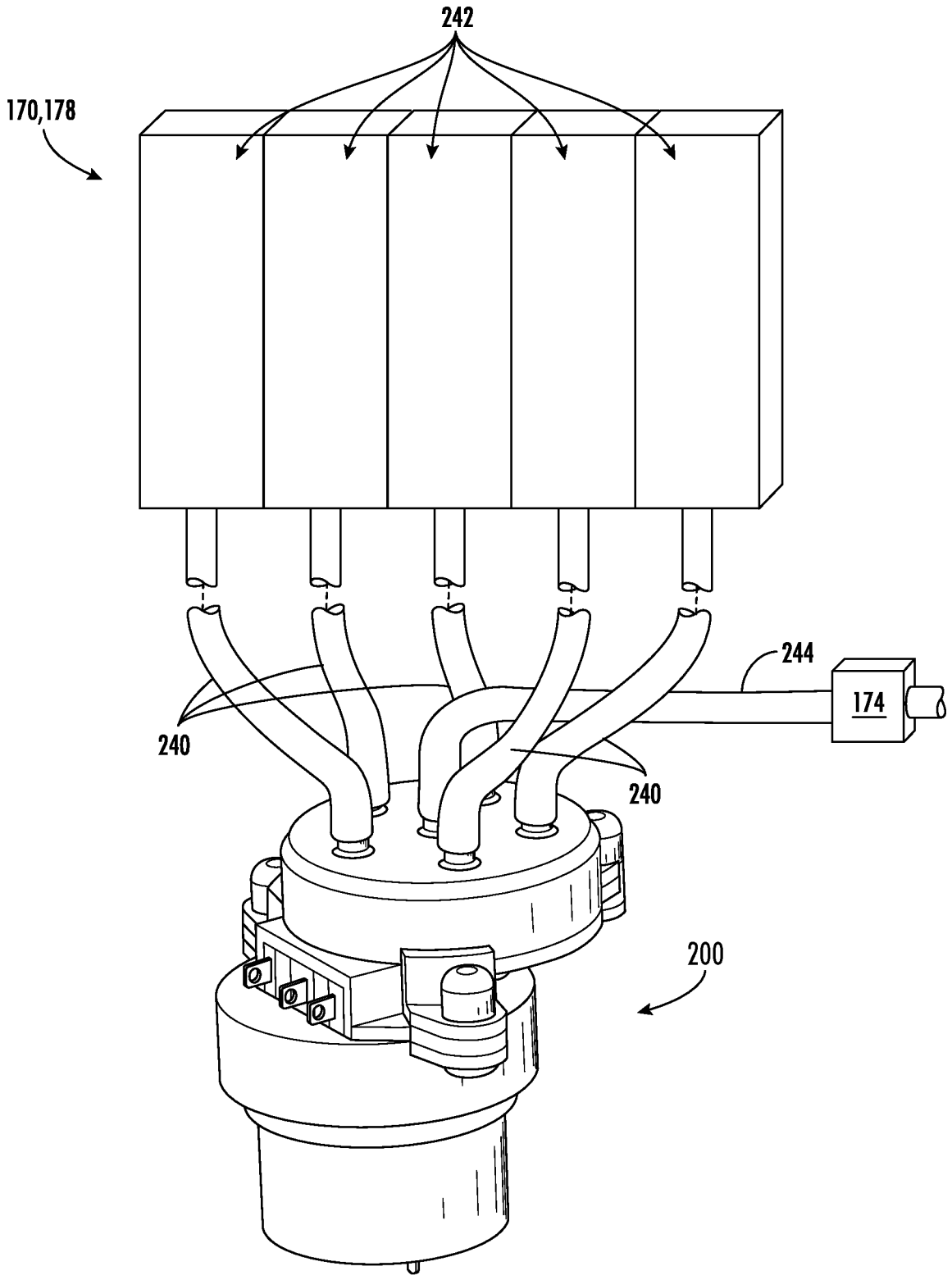
FIG. 7 provides a schematic view of an example fluid reservoir of a washing appliance such as the example dishwashing appliance of FIG. 1 in accordance with an embodiment of the present disclosure.

Referring now to FIG. 7, in example embodiments, the dispenser assembly 200 may be configured to fluidly couple with a fluid reservoir 170 containing a plurality of different fluids 178. For example, each fluid of the plurality of different fluids 178 may be stored within one of a plurality of separate compartments 242 defined within fluid reservoir 170. In such embodiments, the dispenser assembly 200 is fluidly coupled with the fluid reservoir 170 containing the plurality of fluids 178 via a plurality of conduits 240 coupled to the plurality of inlets 208 of the housing 202. For example, each conduit of the plurality of conduits 240 may be in fluid communication with a respective one of the separate compartments 242. In other words, each fluid of the plurality of fluids 178 is different from every other fluid, and each respective one different fluid is in communication with a respective one conduit of the plurality of conduits 240, such that each conduit is in communication with one and only one fluid. Thus, for example, one of the plurality of fluids 178 may flow into the dispenser assembly 200 through one conduit of the plurality of conduits 240 and into one inlet of the plurality of inlets 208. Further, the outlet 210 of housing 202 is configured for being connected to a pump of a washing appliance, such as the pump 174 of the dishwashing appliance 100 shown in FIG. 1, to be provided to a dispenser of the washing appliance, such as the dispenser 176 of the dishwashing appliance 100. As shown in FIG. 7, a pump line 244 may be connected between outlet 210 of the housing 202 and the pump, e.g., pump 174 of the dishwashing appliance 100, for the different fluids 178 to be pumped therethrough. As such, dispenser 176 may be configured for dispensing one of the plurality of different fluids 178 into the appliance at a time. In some example embodiments, one of the plurality of fluids 178 may be one of water or air, whereby dispenser assembly may be configured to run backwards to clean out groove 222 of any residual fluids.

As may be seen from the above, a multi-port disk diverter may be positioned in a dishwasher appliance. The diverter may be driven by a motor and have a positional feedback mechanism. The diverter disk may include a fluid flow channel which is associated with one outlet and multiple inlets present in the stationary housing. The disk may rotate about an axis with the help of the motor to align the channel for the fluid flow through one of the inlets to the outlet present in the center of the housing. Below the diverter disk is a second housing portion which may constrain the parts of the disk diverter system. The feedback wheel, feedback switch and motor may control the rotational position of the diverter disk. In addition, seals are located on the disk to prevent leakage while the fluid flows through the channel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing appliance, comprising:

a tub defining a wash chamber for receipt of articles for washing;

a door for selectively opening and closing the wash chamber; and a dispenser assembly, the dispenser assembly comprising:

a housing comprising a plurality of inlets and an outlet, the housing defining a first portion of a flow path;

a rotatable disk positioned within the housing, the rotatable disk comprising a groove in a top side of the rotatable disk, the groove configured to selectively align with one of the plurality of inlets, the groove defining a second portion of the flow path;

a positioning wheel coupled to the rotatable disk, the positioning wheel configured to provide positional feedback of the rotatable disk; and a motor mechanically coupled to the positioning wheel for driving rotation of the rotatable disk about an axis to align the groove of the rotatable disk with one of the plurality of inlets, wherein, when the groove of the rotatable disk engages with one of the plurality of inlets, the first portion of the flow path and the second portion of the flow path mesh to provide the flow path between one of the plurality of inlets and the outlet.

2. The washing appliance of claim 1, further comprising a groove seal disposed around the groove, the groove seal configured for engaging the housing and fluidly sealing the flow path.

3. The washing appliance of claim 2, wherein the rotatable disk comprises a plurality of inlet seals within the rotatable disk, the plurality of inlet seals configured to engage with each of the plurality of inlets when the inlets are not engaging with the groove.

4. The washing appliance of claim 3, wherein the rotatable disk comprises a protrusion extending through the housing and engaging with one or both of the positioning wheel and the motor.

5. The washing appliance of claim 4, wherein the housing comprises a first housing portion detachably secured to a second housing portion.

6. The washing appliance of claim 5, further comprising a housing seal positioned within a recess formed into the second housing portion.

7. The washing appliance of claim 5, wherein the groove seal is positioned within a recess formed into the rotatable disk around the groove.

8. The washing appliance of claim 1, wherein each inlet seal of the plurality of inlet seals is positioned within a respective recess of a plurality recesses formed into the rotatable disk, the plurality of recesses positioned in the rotatable disk relative to the position of the plurality of inlets of the housing.

9. The washing appliance of claim 1, further comprising a fluid reservoir containing a plurality of different fluids and a plurality of conduits coupled to the fluid reservoir, whereby each conduit of the plurality of conduits is in fluid communication with a respective one of the plurality of different fluids, wherein the dispenser assembly is configured to fluidly couple with the fluid reservoir via the plurality of conduits coupled to the plurality of inlets.

10. The washing appliance of claim 1, further comprising a fluid reservoir, the fluid reservoir comprising a plurality of separate compartments defined within the fluid reservoir, wherein each separate compartment of the plurality of separate compartments contains a respective one different fluid of a plurality of different fluids, further comprising a plurality of conduits coupled to the fluid reservoir, whereby each conduit of the plurality of conduits is in fluid communication with a respective one of the separate compartments, wherein the dispenser assembly is fluidly coupled to the fluid reservoir at the plurality of inlets of the dispenser assembly via the plurality of conduits, whereby each conduit provides a respective one different fluid of the plurality of different fluids to the dispenser assembly.

11. A dispenser assembly for a washing appliance, the dispenser assembly comprising:

a housing comprising a plurality of inlets and an outlet, the housing defining a first portion of a flow path;

a rotatable disk positioned within the housing, the rotatable disk comprising a groove in a top side of the rotatable disk, the groove configured to selectively align with one of the plurality of inlets, the groove defining a second portion of the flow path;

a positioning wheel coupled to the rotatable disk, the positioning wheel configured to provide positional feedback of the rotatable disk; and a motor mechanically coupled to the positioning wheel for driving rotation of the rotatable disk about an axis to align the groove of the rotatable disk with one of the plurality of inlets, wherein, when the groove of the rotatable disk engages with one of the plurality of inlets, the first portion of the flow path and the second portion of the flow path mesh to provide the flow path between one of the plurality of inlets and the outlet.

12. The dispenser assembly of claim 11, further comprising a groove seal disposed around the groove, the groove seal configured for engaging the housing and fluidly sealing the flow path.

13. The dispenser assembly of claim 12, wherein the rotatable disk comprises a plurality of inlet seals within the rotatable disk, the plurality of inlet seals configured to engage with each of the plurality of inlets when the inlets are not engaging with the groove.

14. The dispenser assembly of claim 13, wherein the rotatable disk comprises a protrusion extending through the housing and engaging with one or both of the positioning wheel and the motor.

15. The dispenser assembly of claim 14, wherein the housing comprises a first housing portion detachably secured to a second housing portion.

16. The dispenser assembly of claim 15, further comprising a housing seal positioned within a recess formed into the second housing portion.

17. The dispenser assembly of claim 15, wherein the groove seal is positioned within a recess formed into the rotatable disk around the groove.

18. The dispenser assembly of claim 11, wherein each inlet seal of the plurality of inlet seals is positioned within a respective recess of a plurality recesses formed into the rotatable disk, the plurality of recesses positioned in the rotatable disk relative to the position of the plurality of inlets of the housing.

19. The dispenser assembly of claim 11, further comprising a fluid reservoir containing a plurality of different fluids and a plurality of conduits coupled to the fluid reservoir, whereby each conduit of the plurality of conduits is in fluid communication with a respective one of the plurality of different fluids, wherein the dispenser assembly is configured to fluidly couple with the fluid reservoir via the plurality of conduits coupled to the plurality of inlets.

20. The dispenser assembly of claim 11, further comprising a fluid reservoir, the fluid reservoir comprising a plurality of separate compartments defined within the fluid reservoir, wherein each separate compartment of the plurality of separate compartments contains a respective one different fluid of a plurality of different fluids, further comprising a plurality of conduits coupled to the fluid reservoir, whereby each conduit of the plurality of conduits is in fluid communication with a respective one of the separate compartments, wherein the dispenser assembly is fluidly coupled to the fluid reservoir at the plurality of inlets of the dispenser assembly via the plurality of conduits, whereby each conduit provides a respective one different fluid of the plurality of different fluids to the dispenser assembly.

* * * * *